US011970863B2

(12) United States Patent
Kikugawa

(10) Patent No.: US 11,970,863 B2
(45) Date of Patent: Apr. 30, 2024

(54) STRUCTURE FOR PREVENTING RAIN LEAKAGE IN TREE HOUSE

(71) Applicant: TREEFUL INC., Nago (JP)

(72) Inventor: Satoru Kikugawa, Tokyo (JP)

(73) Assignee: TREEFUL INC., Nago (JP)

( * ) Notice: Subject to any disclaimer, the term of this patent is extended or adjusted under 35 U.S.C. 154(b) by 182 days.

(21) Appl. No.: 17/775,645

(22) PCT Filed: Aug. 5, 2020

(86) PCT No.: PCT/JP2020/030077
§ 371 (c)(1),
(2) Date: May 10, 2022

(87) PCT Pub. No.: WO2021/131135
PCT Pub. Date: Jul. 1, 2021

(65) Prior Publication Data

US 2022/0396950 A1 Dec. 15, 2022

(30) Foreign Application Priority Data

Dec. 23, 2019 (JP) ..... 2019-231611

(51) Int. Cl.
*E04D 13/14* (2006.01)

(52) U.S. Cl.
CPC ..... *E04D 13/14* (2013.01)

(58) Field of Classification Search
CPC . E04B 1/34; E04D 13/14; E04D 11/02; E04H 15/04; E04H 1/1205
USPC ..... 52/58
See application file for complete search history.

(56) References Cited

U.S. PATENT DOCUMENTS 5,522,186 A * 6/1996 Jarman ..... E04H 15/04 182/187
6,185,885 B1 * 2/2001 Thaler ..... E04D 13/1407 52/219
2016/0024792 A1 1/2016 Grubka et al.
2019/0330854 A1 * 10/2019 Reynolds ..... E04D 13/1407

FOREIGN PATENT DOCUMENTS

DE 202009015778 * 3/2011
JP S50-029311 Y1 8/1975
JP S64-051936 A 2/1989
JP H10-140755 A 5/1998
(Continued)

OTHER PUBLICATIONS

"Fuji Tree House," Jan. 12, 2016, [https://web.archive.org/web/20160112034137/http://ekip.co.jp/works/fuji/].
(Continued)

*Primary Examiner* — Mark R Wendell
(74) *Attorney, Agent, or Firm* — Oliff PLC

(57) ABSTRACT

A light and relatively simple structure for preventing rain leakage in a tree house. A tree house using a trunk of a tree as a pillar inevitably has a gap between the trunk and a roof. Thus, a plurality of two-layer waterproof sheets are placed on top of the roof, so that each sheet can absorb rain water that would run down the trunk of the tree and enter the gap, and can drain the rain water onto the roof. This makes it possible to prevent rain leakage in the tree house through the gap between the trunk of the tree and the roof.

11 Claims, 7 Drawing Sheets

(56) References Cited

FOREIGN PATENT DOCUMENTS

| | | | |
|---|---|---|---|
| JP | 2004-052473 | A | 2/2004 |
| KR | 102124608 | * | 6/2020 |

OTHER PUBLICATIONS

May 1, 2020 Office Action issued in Japanese Patent Application No. 2019-231611.
Oct. 13, 2020 International Search Report issued in International Patent Application No. PCT/JP2020/030077.

* cited by examiner

STRUCTURE FOR PREVENTING RAIN LEAKAGE IN TREE HOUSE

TECHNICAL FIELD

The present invention relates to a structure for preventing rain leakage in a tree house.

BACKGROUND ART

Tree houses, which are buildings built on actually living trees or using real living trees as bases, have been built as houses of natives in tropical rainforest areas such as Southeast Asia and South and Central America. It has been considered the reason that these natives have settled in tree houses is based on the problem of the land on which they build their houses or to protect themselves from hostile forces and beasts.

By the way, in recent years, the number of cases of building tree houses for the purposes of hobbies, entertainment, recreation and tourism is increasing. This is because people have come to prefer to enjoy a living environment that is integrated with nature by living and staying in a tree house. Therefore, the tree house has come to be recognized as a kind of tourism resource.

To build this tree house, for example, conifers with few branches, broad-leaved trees having spreading in branches, etc., are used, and it is necessary to design in consideration of the size, height, strength, hardness, thickness, branch swing, habitat, the growth situation of the tree, etc., of each tree. In other words, it is also a big attraction of the tree house to carry out design of a tree house with free thinking and creativity according to the situation of each tree.

Here, when a tree house is constructed using a conifer with few branches, the trunk of the conifer is vertically upright so that the trunk can be used as a pillar. In this way, if the trunk is used as a pillar, a sturdy and good-looking tree house can be constructed, but on the other hand, it is necessary to penetrate the trunk through the roof due to the design, so that rain leakage occurs from the gap between the roof and the trunk.

CITATION LIST

Patent Literature

Patent Literature 1: Japanese Patent Application Publication No. H10-140755A

DISCLOSURE OF INVENTION

Problem to be Solved by the Invention

In general, there are unevenness on the surface of a tree, and the bark is made of water-permeable fibers, so that the bark inevitably allows rainwater to pass through.

FIG. 8 is a drawing for describing a structure of preventing rain leakage using a conventional waterproof sheet 300. The waterproof sheet 300 is wrapped around the trunk (pillar) 500 and firmly tied with an elastic code (rubber string) 400 or the like to make it waterproof against rainwater. As described above, since the surface of the trunk 500 is bark, even if the waterproof sheet 300 is tied with the elastic cord 400 so as to be as close as possible, part of rainwater inevitably infiltrates through the gap 200 between the trunk 500 and the roof 100 as shown by the arrow in FIG. 6.

Also, even if the gap 200 between the trunk 500 and the roof 100 is coated with a silicone resin used for a glass joint portion of a water tank, rainwater will still infiltrate. The bark is constantly growing, and the old bark peels off, so that the gaps gradually increase and rain leakages further increase.

As in the invention described in Patent Literature 1, as a structure for preventing rain leakages in the corner ridge, a structure for preventing rain leakages which is to be a relatively simple structure and a low-cost has been proposed.

However, when the trunk is used as a pillar in a tree house, the growing tree is targeted and there is a limit in the weight, so that the technology used in a normal house (for example, the invention described in Patent Literature 1) cannot correspond to.

Therefore, an object of the present invention is to provide a structure for preventing rain leakage in a tree house as much as possible, with lightweight and a relatively simple structure.

SUMMARY OF THE INVENTION(S)

The invention described in claim 1 provides a structure for preventing rain leakage in a tree house that is a structure for preventing rain leakage in a tree house built with a trunk as a pillar, which comprises, on an upper part of a roof of the tree house, a two-layer waterproof sheet comprising two layers of a waterproof sheet and a non-woven fabric provided with water absorption property, and drainage property to drain absorbed water from an opposite end, being wound to the trunk by direct contact with the non-woven fabric and a surface of the trunk, so that rainwater is prevented from invading indoors along the trunk.

The invention described in claim 2 provides a structure for preventing rain leakage in a tree house that is a structure for preventing rain leakage in a tree house built with a trunk as a pillar, which comprises, on an upper part of a roof of the tree house, a two-layer waterproof sheet comprising two layers of a waterproof sheet and a non-woven fabric provided with water absorption property, and drainage property, being installed by winding the trunk with a plurality of sheets continuously, so that rainwater is prevented from invading indoors along the trunk.

The invention described in claim 3 provides the structure for preventing rain leakage of a tree house according to claim 1 or claim 2, wherein the two-layer waterproof sheet comprises a material in which an inner side of the outer waterproof sheet being made of an adhesive material, and the waterproof sheet and the non-woven fabric are integrated by this adhesive force.

The invention described in claim 4 provides the structure for preventing rain leakage of a tree house according to claim 1, claim 2 or claim 3, wherein the two-layer waterproof sheet is configured by a double-sided adhesive tape on an overlapping portion, which is a surface that overlaps in a vertical direction when the waterproof sheet is installed.

The invention described in claim 5 provides the structure for preventing rain leakage of a tree house according to claim 1, claim 2, claim 3 or claim 4, wherein the non-woven fabric of the two-layer waterproof sheet is a material made by applying a hydrophilic treatment to polyester fibers.

The invention described in claim 6 provides the structure for preventing rain leakage of a tree house according to claim 1, wherein a rope made of a waterproof or water-repellent material is wrapped around the gap between the roof of the tree house and the trunk to close the gap.

EFFECT OF THE INVENTION(S)

According to the present invention, in a tree house having a tree trunk as a pillar, it is possible to efficiently prevent rain leakage with lightweight and a relatively simple structure.

BEST MODE(S) FOR CARRYING OUT THE INVENTION

(1) Outline of Embodiment

Hereinafter, a preferred embodiment of the present invention will be described in detail by referring to FIGS. 1 to 7.

Figure 1:
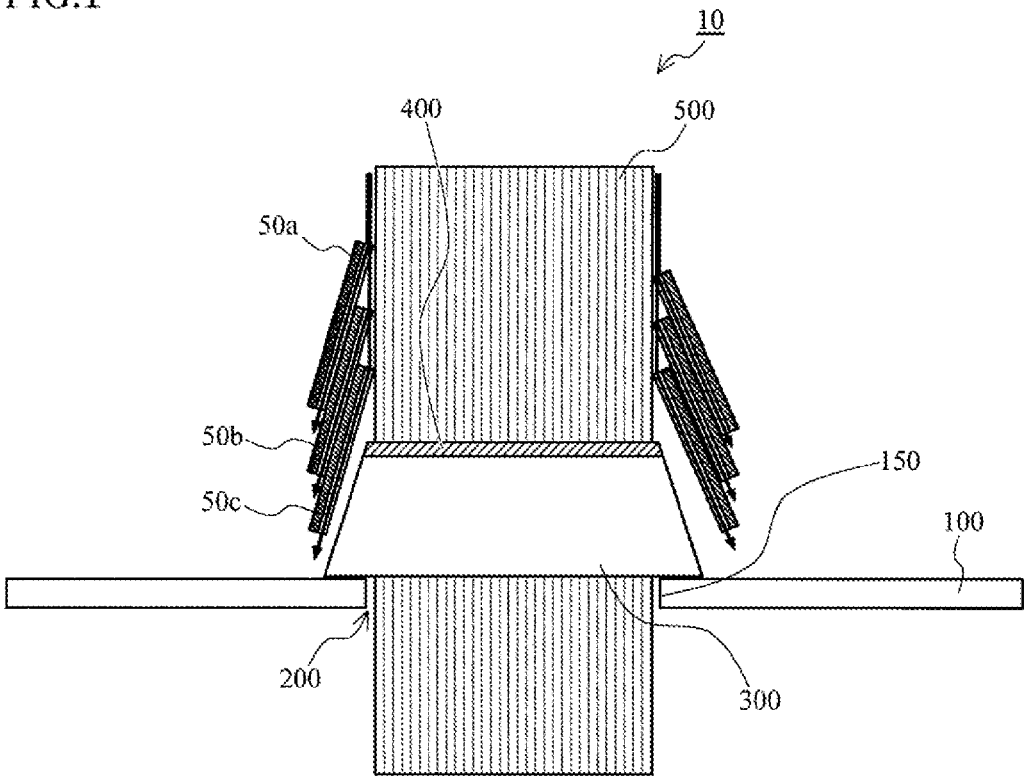
FIG. 1 is a drawing for describing a configuration of the structure for preventing rain leakage according to the present embodiment.

FIG. 1 is a drawing for describing a configuration of a structure for preventing rain leakage in a tree house according to the present embodiment.

As shown in this drawing, the structure for preventing rain leakage of this tree house is installed so that a roof 100 of a tree house 10 penetrates a trunk 500 of a tree (for example, a conifer). Conifers are highly upright and are convenient to use as pillars in the tree house 10. In this way, when the trunk 500 of the conifer is used as a pillar, it is said that a tree house that looks good, is robust, and has high stability can be built.

Between the trunk 500 of this tree and the roof 100, a gap 200 is inevitably generated. Therefore, by installing a plurality of two-layer waterproof sheets 50*a*, 50*b*, and 50*c* on the upper part of the roof 100, each of them absorbs (absorbed by non-woven fabric) rainwater that enters the gap 200 through the trunk 500 of the tree and drains water on the roof 100. By doing so, it is possible to prevent rain leakage from the gap 200 between the trunk 500 of the tree and the roof 100 in the tree house 10.

(2) Details of Embodiment

The tree house 10 shown in FIG. 1 is built with a trunk 500 of a tree as a pillar.

In this way, since the trunk 500 is used as a pillar, the roof 100 is structured so that the trunk 500 penetrates therethrough. In order for the trunk 500 to penetrate the roof 100, the roof 100 is divided into two, and semi-circular holes 150 having a shape as close as possible to the shape of the trunk 500 are provided on one side corresponding to both the divided roofs.

Then, in this hole 150, both are adhered so as to surround the trunk 500 from both sides to install the roof 100. The shape of the roof 100 shown in FIG. 1 is a planar shaped flat roof, but it may be a pent roof with a slope on one side or a gable roof with a slope on both sides. It is necessary to apply waterproof treatment to any shape of roof. In the case of a gable roof, it is desirable to install a ridge wrapping plate, which is a metal plate covering the roof ridge, to prevent rainwater from infiltration.

At the lower part of the roof 100, a floor portion is provided and a living portion as a normal house exists between the both.

In addition, with regard to the trunk 500 (tree), the lower part thereof has roots in the ground and the upper part thereof has leaves as a tree. In some cases, multiple branches may extend laterally. The structure may be such that the floor is supported by branches.

Even if the semi-circular hole 150 of the roof 100 is formed with matching with the shape of the trunk 500, a gap 200 for allowing rainwater to pass is inevitably generated at the contact portion between the trunk 500 and the roof 100.

Figure 8:
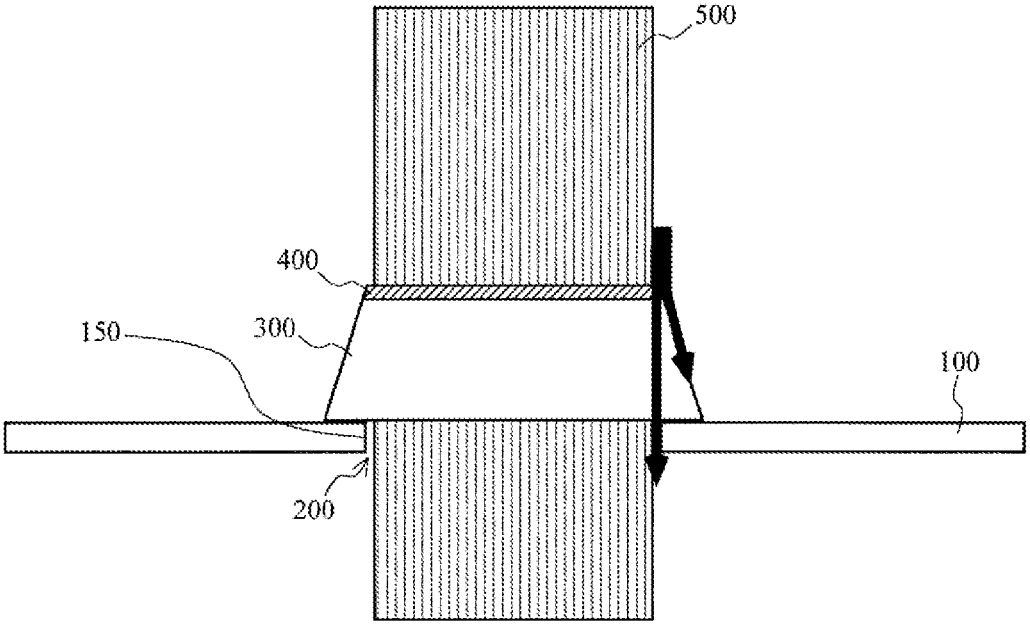
FIG. 8 is a drawing for describing the conventional structure for preventing rain leakage.

First, at the upper part of the gap 200, a waterproof sheet 300 is provided by winding around the trunk 500, similarly to the prior art shown in FIG. 8. For this winding, an elastic cord 400 is used to firmly fix the trunk 500.

Subsequently, on the upper part thereof, a two-layer waterproof sheet 50 is installed. In the embodiment shown in this drawing, the two-layer waterproof sheet 50 is installed by making it in three layers, but it may be a single layer or two layers. Also, it may be four or more layers. The number of layers may be appropriately selected depending on the installation situation.

Also, in this embodiment, the gap 200 may be coated with a silicone resin.

Figure 2:
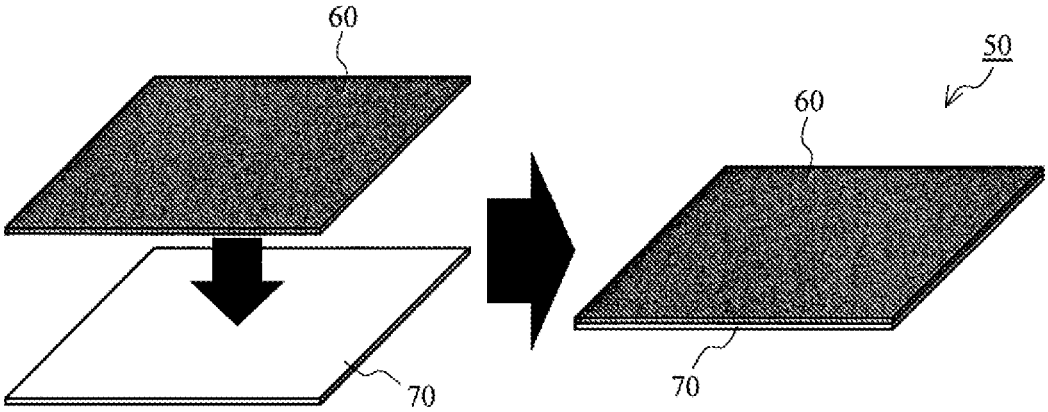
FIG. 2 is a drawing for describing the two-layer waterproof sheet according to the present embodiment.

FIG. 2 is a drawing for describing the two-layer waterproof sheet 50.

The two-layer waterproof sheet 50 is formed by laminating a waterproof sheet 60 and a non-woven fabric 70 having high water absorption and drainage.

For the waterproof sheet 60, for example, a rubber sheet or a vinyl chloride sheet is used. A sheet may be made of any other material as long as it has waterproof property.

A non-woven fabric refers to a cloth in which a fiber sheet (web) is mechanically, chemically, and thermally treated without going through the form of a thread, and is joined by an adhesive or the self-bonding force of the fiber. Usually, it is formed as a sheet state by a hot press, a high-pressure water flow method, etc., to increase the strength and fix the fibers. Since the non-woven fabric can be mass-produced industrially, it can be obtained at a relatively low cost.

As the non-woven fabric 70 used in this embodiment, one having high water absorption and drainage is adopted. Specifically, polyester fibers that have been subjected to hydrophilic treatment are preferable. The hydrophilic treatment may be mentioned, for example, a method of performing a hydrophilic treatment with direct plasma and a jet, and a method of adding a hydrophilic agent in the non-woven fabric manufacturing process, etc.

When forming the two-layer waterproof sheet 50, the waterproof sheet 60 and the non-woven fabric 70 may be bonded together with an adhesive.

Alternatively, an adhesive tape (that subjected to waterproof) may be used for the waterproof sheet 60 itself.

Figure 3:
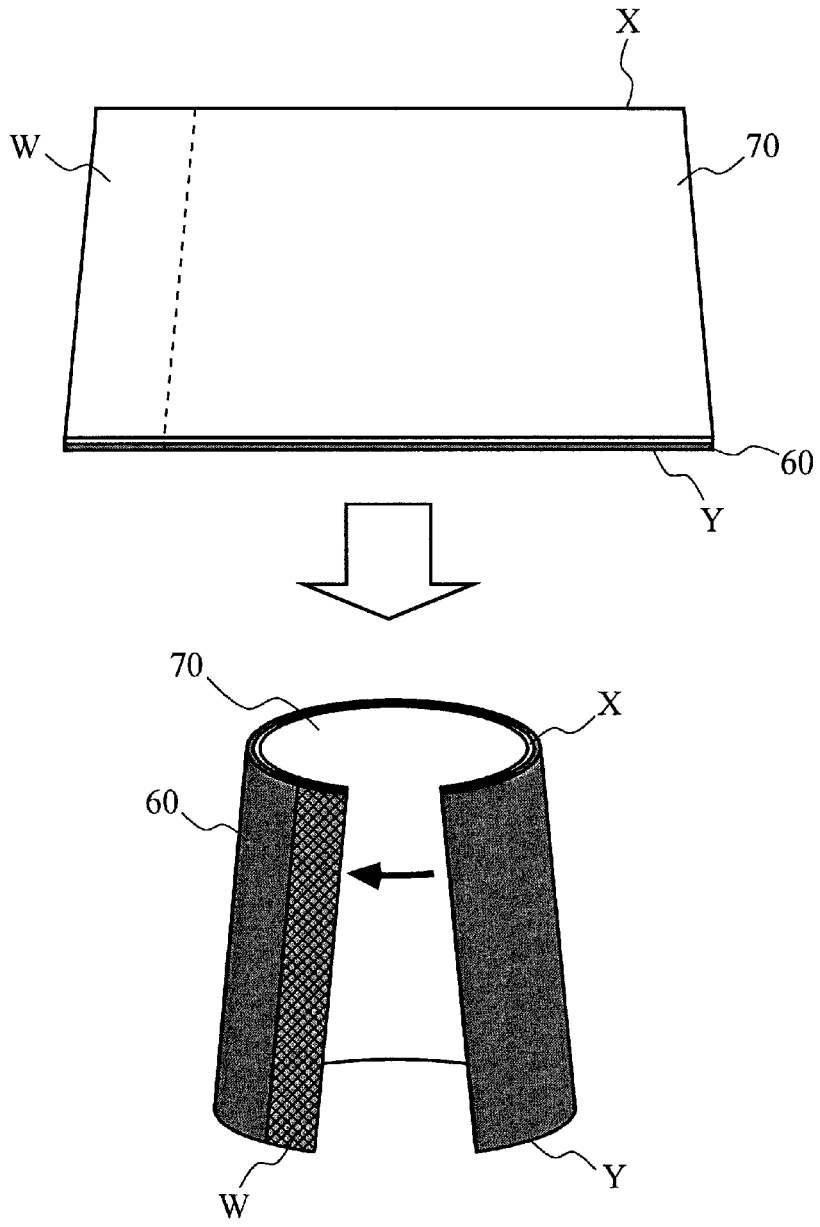
FIG. 3 is a drawing for describing installation of the two-layer waterproof sheet according to the present embodiment.

FIG. 3 is a drawing for describing a place (installation) in which the two-layer waterproof sheet 50 is wound around the trunk 500.

This two-layer waterproof sheet 50 has a trapezoidal shape in which the side X is shorter than the side Y so as to have a shape (skirt shape) that expands downward when installed. A size of the two-layer waterproof sheet 50 is set so that the side X has a larger value than the circumference of the trunk 500. Accordingly, it is necessary to appropriately select depending on the size of the trunk 500.

When installing, the side of the non-woven fabric 70 is made the inside (trunk 500 side). By doing so, the non-woven fabric 70 and the surface of the trunk 500 come into direct contact with each other.

This two-layer waterproof sheet 50 absorbs rainwater from the end X (upper side) that comes into direct contact with the trunk 500, and drains it from the end Y on the opposite side (lower side).

Next, when the two-layer waterproof sheet 50 is installed, an overlapping portion W that overlaps in the vertical direction will be explained.

As described above, the size of the two-layer waterproof sheet 50 is set so that the side X is larger than the circumference of the trunk 500. This is to serve as a "glue allowance" (overlapping portion) for overlapping and adhering both ends of the two-layer waterproof sheet 50. In FIG. 3, it is represented by W.

A size of the overlapping portion W is appropriately set by the overlapping portion W between about 10% and 50% of the whole.

In this overlapping portion W, the outside (adhesive surface) of the waterproof sheet 60 which is the inside (covered side) and the inside of the non-woven fabric 70 which is the outside (covering side) are bonded with an adhesive to install the two-layer waterproof sheet 50.

A material having adhesive strength may be applied in advance to the outside of the waterproof sheet 60 of the overlapping portion W. By doing so, the installation work of the two-layer waterproof sheet 50 becomes easy.

Therefore, the waterproof sheet 60 may be configured as a double-sided adhesive tape only on the portion of the overlapping portion W of the two-layer waterproof sheet 50. The inside is adhered to the non-woven fabric 70, and the outside is adhered to the inside of the overlapped non-woven fabric 70. At this time, it is desirable to attach a release paper to the overlapping portion W of the waterproof sheet 60 in advance so as not to adhere to other materials before the work.

Figure 4:
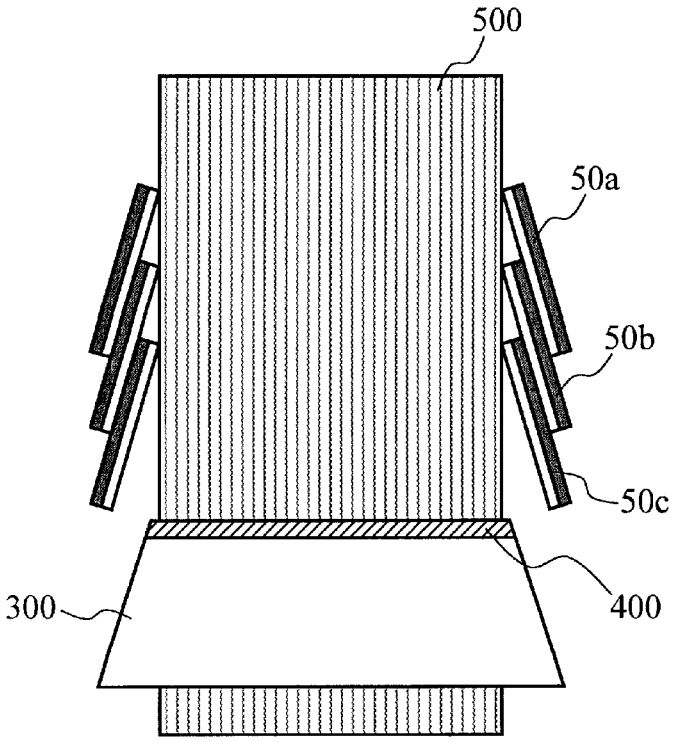
FIG. 4 is a drawing for describing the cross section at the time of installing the two-layer waterproof sheet according to the present embodiment.

FIG. 4 is a drawing for describing a cross section when the two-layer waterproof sheet according to the present embodiment is installed.

Figure 5:
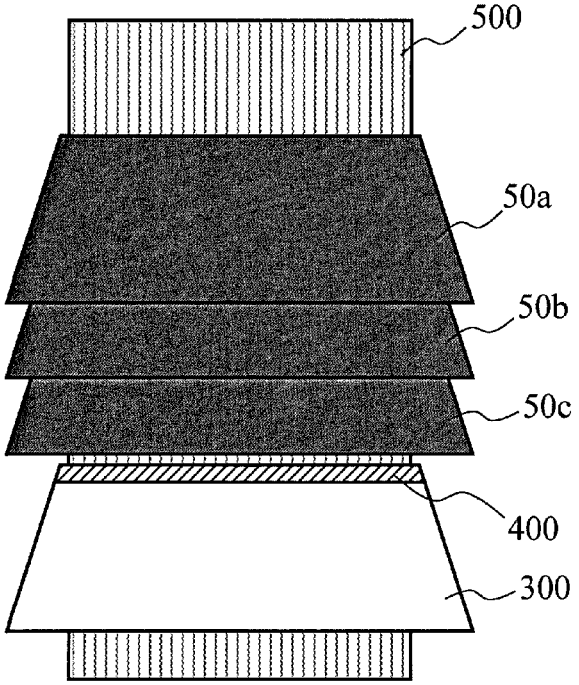
FIG. 5 is a drawing for describing the appearance at the time of installing the two-layer waterproof sheet according to the present embodiment.

Also, FIG. 5 is a drawing for describing the appearance when the two-layer waterproof sheet according to the present embodiment is installed.

In the embodiment shown in this drawing, the two-layer waterproof sheet 50 is installed in three stages (50*a*, 50*b* and 50*c*). In addition, a waterproof sheet 300, which is prior art, is also installed.

The two-layer waterproof sheet 50 may be, as shown in FIG. 4 and FIG. 5, installed so as to overlap in the vertical direction, but the present invention is not limited to this, and for example, it may be installed apart from each other at a certain distance.

According to the embodiment of the present invention, the rainwater that invades through the trunk 500 is absorbed from the upper end X of the non-woven fabric 70 of the two-layer waterproof sheet 50 installed in contact with the trunk 500 and drained from the lower end Y.

If this two-layer waterproof sheet 50 is installed over a plurality of stages, it is possible to more certainly prevent rainwater from invading through the gap 200.

The two-layer waterproof sheet 50 according to the embodiment of the present invention is a sheet having a two-layer structure consisting of a waterproof sheet 60 and a non-woven fabric 70 having high water absorption and drainage.

When installing this two-layer waterproof sheet 50, it is desirable to form an overlapping portion W having an adhesive force in advance in order to improve workability.

It should be noted that the waterproof sheet 300, which is prior art, and coating the gap 200 with a silicone resin may be used in combination.

Figure 6:
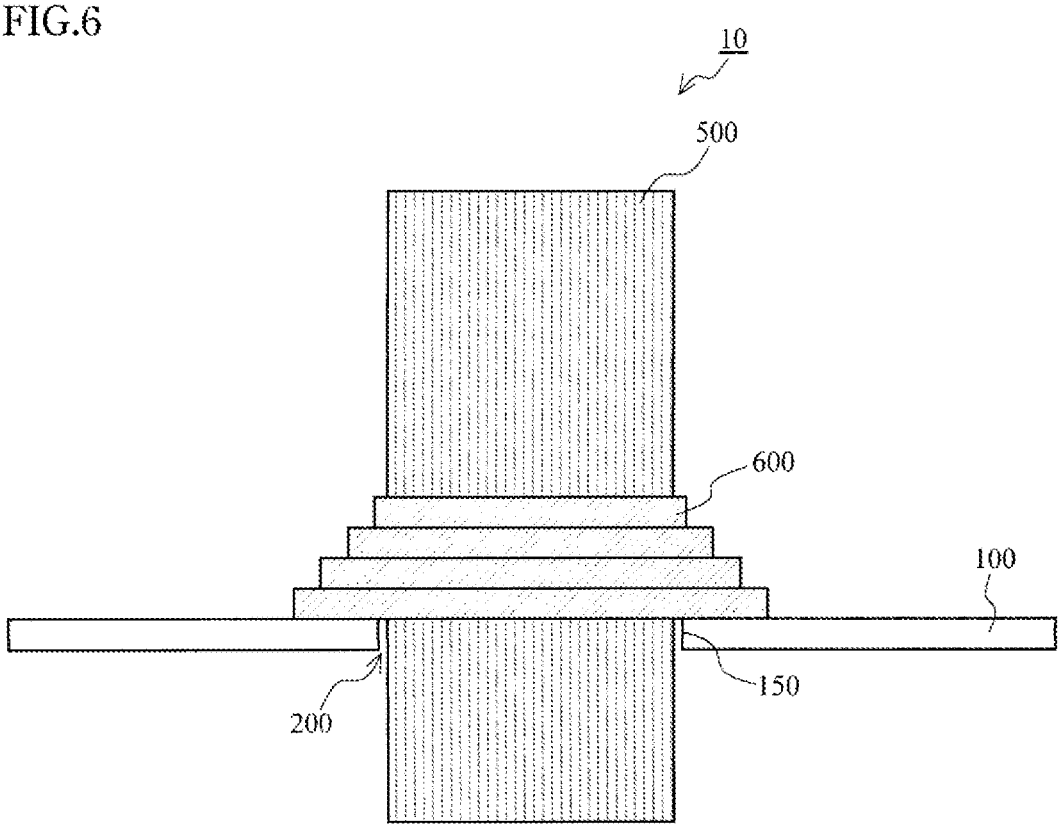
FIG. 6 is a drawing for describing the configuration of the structure for preventing rain leakage using the rope according to another embodiment.

FIG. 6 is a drawing for describing, as another embodiment, the configuration in which a rope 600 is wound around a gap 200 between the roof 100 and the trunk 500 to close the gap.

The rope 600 wound here is preferably a rope made of a material that does not absorb water and is resistant to water (waterproof property), for example, polyethylene, polypropylene, or polyester.

Also, a water-repellent material such as a rope made of Nylon (trade mark) may be used.

With regard to a winding method of the rope 600, as shown in FIG. 6, it is preferable to wind it a plurality of times so as to completely close the gap 200.

The winding methods are possible with various manner, and as shown in FIG. 6, it is desirable to employ a method in which the lower side is wound with a plurality of times and the number of windings on the upper side is gradually reduced (the winding cross section is conical).

Also, the winding method may be such that the winding is carried out the same number of times multiple times (the winding cross section is rectangular).

By winding the rope 600 in this way, the gap 200 can be completely closed, and by the waterproof property or water repellency of the rope 600, it can firmly prevent rainwater from invading through the gap 200.

Figure 7:
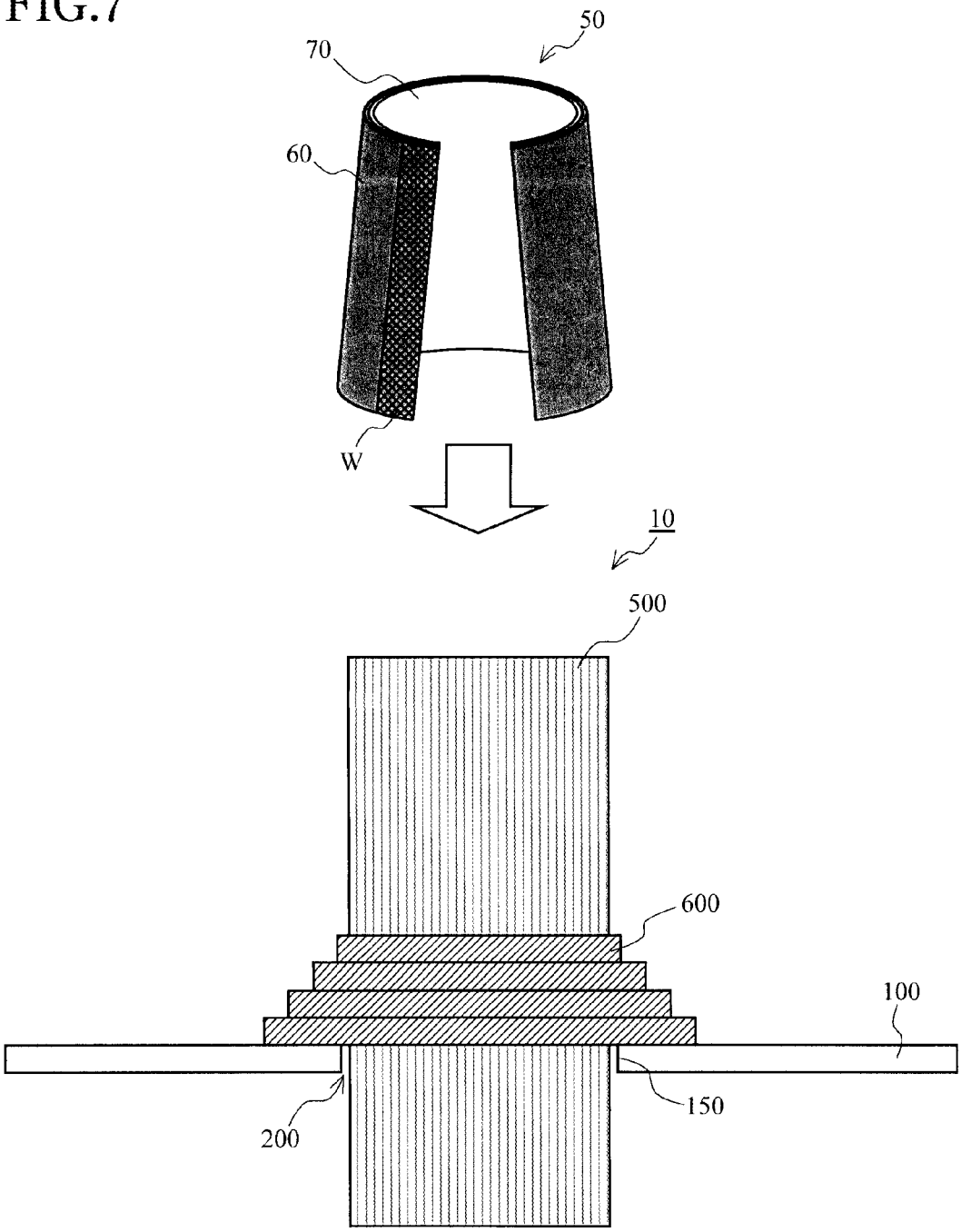
FIG. 7 is a drawing for describing the example which used the two-layer waterproof sheet in the structure for preventing rain leakage using the rope according to another embodiment.

FIG. 7 is a drawing for describing an example in which the other embodiment shown in FIG. 6 and the two-layer waterproof sheet 50 are used in combination.

As shown in this figure, the two-layer waterproof sheet 50 is arranged so that the non-woven fabric 70 side is in contact with the trunk 500.

In this way, by using the rope 600 and the two-layer waterproof sheet 50 in combination, it is possible to more certainly prevent the invasion of rainwater in the tree house 10.

Further, it is more preferable to use the waterproof sheet 300 having waterproof capability.

REFERENCE SIGNS LIST

10 Tree house
50 Two-layer waterproof sheet
60 Waterproof sheet
70 Non-woven fabric
100 Roof

150 Hole
200 Gap
300 Waterproof sheet
400 Elastic cord
500 Trunk
600 Rope

The invention claimed is:

1. A structure for preventing rain leakage in a tree house that is a structure for preventing rain leakage in a tree house built with a trunk as a pillar, which comprises, on an upper part of a roof of the tree house, a two-layer waterproof sheet comprising two layers of a waterproof sheet and a non-woven fabric provided with water absorption property, and drainage property to drain absorbed water from an opposite end, being wound to the trunk by direct contact with the non-woven fabric and a surface of the trunk, so that rainwater is prevented from invading indoors along the trunk.

2. The structure for preventing rain leakage of a tree house according to claim 1, wherein the two-layer waterproof sheet comprises a material in which an inner side of the outer waterproof sheet being made of an adhesive material, and the waterproof sheet and the non-woven fabric are integrated by this adhesive force.

3. The structure for preventing rain leakage of a tree house according to claim 1, wherein the two-layer waterproof sheet is configured by a double-sided adhesive tape on an overlapping portion, which is a surface that overlaps in the vertical direction when the waterproof sheet is installed.

4. The structure for preventing rain leakage of a tree house according to claim 1, wherein the non-woven fabric of the two-layer waterproof sheet is a material made by applying a hydrophilic treatment to polyester fibers.

5. The structure for preventing rain leakage of a tree house according to claim 1, wherein a rope made of a waterproof or water-repellent material is wrapped around the gap between the roof of the tree house and the trunk to close the gap.

6. A structure for preventing rain leakage in a tree house that is a structure for preventing rain leakage in a tree house built with a trunk as a pillar, which comprises, on an upper part of a roof of the tree house, a two-layer waterproof sheet comprising two layers of a waterproof sheet and a non-woven fabric provided with water absorption property, and drainage property, being installed by winding the trunk with a plurality of sheets continuously, so that rainwater is prevented from invading indoors along the trunk.

7. The structure for preventing rain leakage of a tree house according to claim 6, wherein the two-layer waterproof sheet comprises a material in which an inner side of the outer waterproof sheet being made of an adhesive material, and the waterproof sheet and the non-woven fabric are integrated by this adhesive force.

8. The structure for preventing rain leakage of a tree house according to claim 6, wherein the two-layer waterproof sheet is configured by a double-sided adhesive tape on an overlapping portion, which is a surface that overlaps in the vertical direction when the waterproof sheet is installed.

9. The structure for preventing rain leakage of a tree house according to claim 6, wherein the non-woven fabric of the two-layer waterproof sheet is a material made by applying a hydrophilic treatment to polyester fibers.

10. A tree house comprising:

a pillar comprising a tree trunk, a roof, and a structure for preventing rain leakage as defined in claim 6.

11. A tree house comprising:

a pillar comprising a tree trunk, a roof, and a structure for preventing rain leakage as defined in claim 1.

* * * * *